US011801202B2

(12) United States Patent
Ueta et al.

(10) Patent No.: US 11,801,202 B2
(45) Date of Patent: Oct. 31, 2023

(54) MEDICINE DISPENSING APPARATUS

(71) Applicant: PHC Holdings Corporation, Tokyo (JP)

(72) Inventors: Toshiaki Ueta, Tokushima (JP); Takeshi Azuma, Ehime (JP)

(73) Assignee: PHC HOLDINGS CORPORATION, Tokyo (JP)

( * ) Notice: Subject to any disclaimer, the term of this patent is extended or adjusted under 35 U.S.C. 154(b) by 0 days.

(21) Appl. No.: 17/835,534

(22) Filed: Jun. 8, 2022

(65) Prior Publication Data

US 2022/0296473 A1 Sep. 22, 2022

Related U.S. Application Data

(63) Continuation of application No. PCT/JP2020/043460, filed on Nov. 20, 2020.

(30) Foreign Application Priority Data

Dec. 13, 2019 (JP) ..... 2019-225239

(51) Int. Cl.
*A61J 7/00* (2006.01)
*B65B 1/02* (2006.01)
*B65B 1/06* (2006.01)

(52) U.S. Cl.
CPC ..... *A61J 7/0076* (2013.01); *B65B 1/02* (2013.01); *B65B 1/06* (2013.01)

(58) Field of Classification Search
CPC ..... A61J 7/0076
See application file for complete search history.

(56) References Cited

U.S. PATENT DOCUMENTS 7,848,846 B2 * 12/2010 Uema ..... G07F 17/0092 221/83
7,878,366 B2 * 2/2011 Cicognani ..... B65B 5/103 53/244
2008/0245820 A1 * 10/2008 Pfister ..... G07F 11/44 221/124
2009/0218363 A1 * 9/2009 Terzini ..... B65B 5/103 221/4

(Continued)

FOREIGN PATENT DOCUMENTS

EP 2 067 699 A1 6/2009
JP S51-014477 A 2/1976
JP S57-002241 Y2 1/1982

(Continued)

OTHER PUBLICATIONS

Extended European Search Report dated Dec. 2, 2022 issued in the corresponding European Patent Application No. 20900101.5.

(Continued)

*Primary Examiner* — Gene O Crawford
*Assistant Examiner* — Ayodeji T Ojofeitimi
(74) *Attorney, Agent, or Firm* — McDermott Will & Emery LLP

(57) ABSTRACT

A medicine dispensing apparatus includes: a hopper that receives a medicine and causes the medicine to proceed to a guiding port; a holding section that is provided to the hopper and holds the medicine; and a delivering section that is provided to the hopper and delivers the medicine held by the holding section to the guiding port.

5 Claims, 4 Drawing Sheets

(56) References Cited

U.S. PATENT DOCUMENTS

| | | | |
|---|---|---|---|
| 2012/0151882 | A1 | 6/2012 | Nakano |
| 2013/0136792 | A1 | 5/2013 | Draper et al. |

FOREIGN PATENT DOCUMENTS

| | | | |
|---|---|---|---|
| JP | H11-139403 | A | 5/1999 |
| JP | 2000-344201 | A | 12/2000 |
| JP | 2013-528439 | A | 7/2013 |
| KR | 10-2014-0135025 | A | 11/2014 |
| WO | 2010/150763 | A1 | 12/2010 |

OTHER PUBLICATIONS

International Search Report dated Feb. 9, 2021 issued in International Patent Application No. PCT/JP2020/043460, with English translation.

* cited by examiner

MEDICINE DISPENSING APPARATUS

CROSS-REFERENCE OF RELATED APPLICATIONS

This application is a Continuation of International Patent Application No. PCT/JP2020/043460, filed on Nov. 20, 2020, which in turn claims the benefit of Japanese Patent Application No. 2019-225239, filed on Dec. 13, 2019, the entire disclosures of which Applications are incorporated by reference herein.

TECHNICAL FIELD

The present disclosure relates to a medicine dispensing apparatus.

BACKGROUND ART

Patent Literature 1 discloses a medicine dispensing apparatus that lets out medicines specified by a prescription from a plurality of medicine storage containers arranged vertically and horizontally, collects the let-out medicines in a hopper located at the bottom of these medicine storage containers, and supplies the medicines in a packet.

CITATION LIST

Patent Literature

PTL 1

Japanese Examined Utility Model (Registration) Application Publication No. S57-2241

SUMMARY OF INVENTION

Technical Problem

In the medicine dispensing apparatus described above, there is a risk that a medicine stays in a passage or does not move smoothly depending on the configuration or shape of the hopper. Additionally, the medicine may take a long time to move. These cases possibly make the dispensing time of the medicine longer or cause a problem of supplying a wrong set of medicines in a packet.

It is an objective of the present disclosure to provide a medicine dispensing apparatus in which a medicine can proceed through a hopper smoothly in a short time.

Solution to Problem

To achieve the objective, a medicine dispensing apparatus according to an embodiment of the present disclosure includes: a hopper that receives a medicine on a base wall with inclination and causes the medicine to proceed to a guiding port along the base wall; a holding section that blocks the medicine proceeding due to the inclination of the hopper; and a delivering section that delivers the medicine blocked by the holding section to the guiding port so that the medicine proceeds on the hopper.

Advantageous Effects of Invention

According to a medicine dispensing apparatus of the present disclosure, it is possible for a medicine to proceed through a hopper smoothly.

DESCRIPTION OF EMBODIMENTS

Embodiment 1

Figure 1:
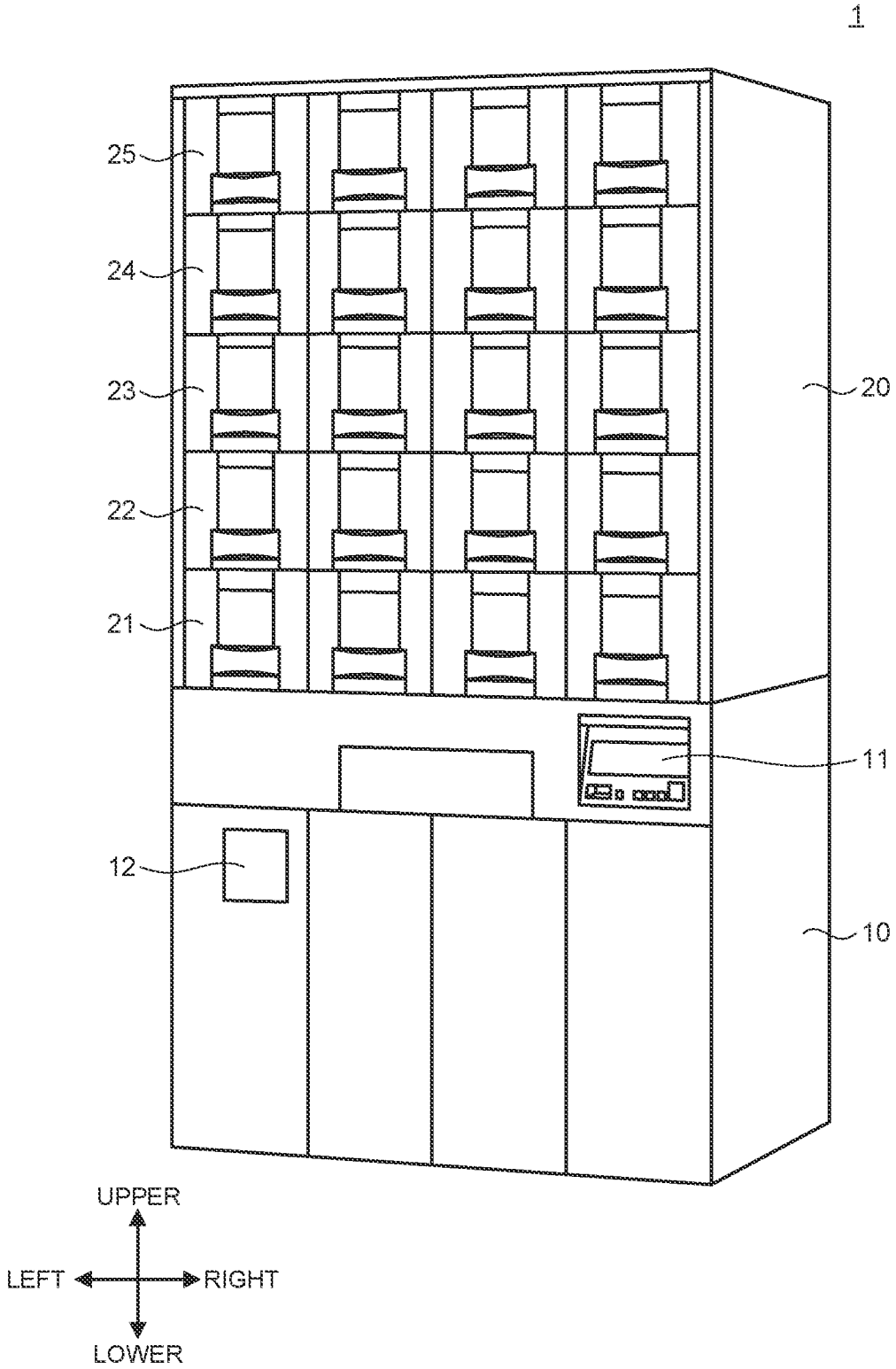
FIG. 1 is a perspective view of a medicine dispensing apparatus according to Embodiment 1 of the present disclosure.
Figure 2:
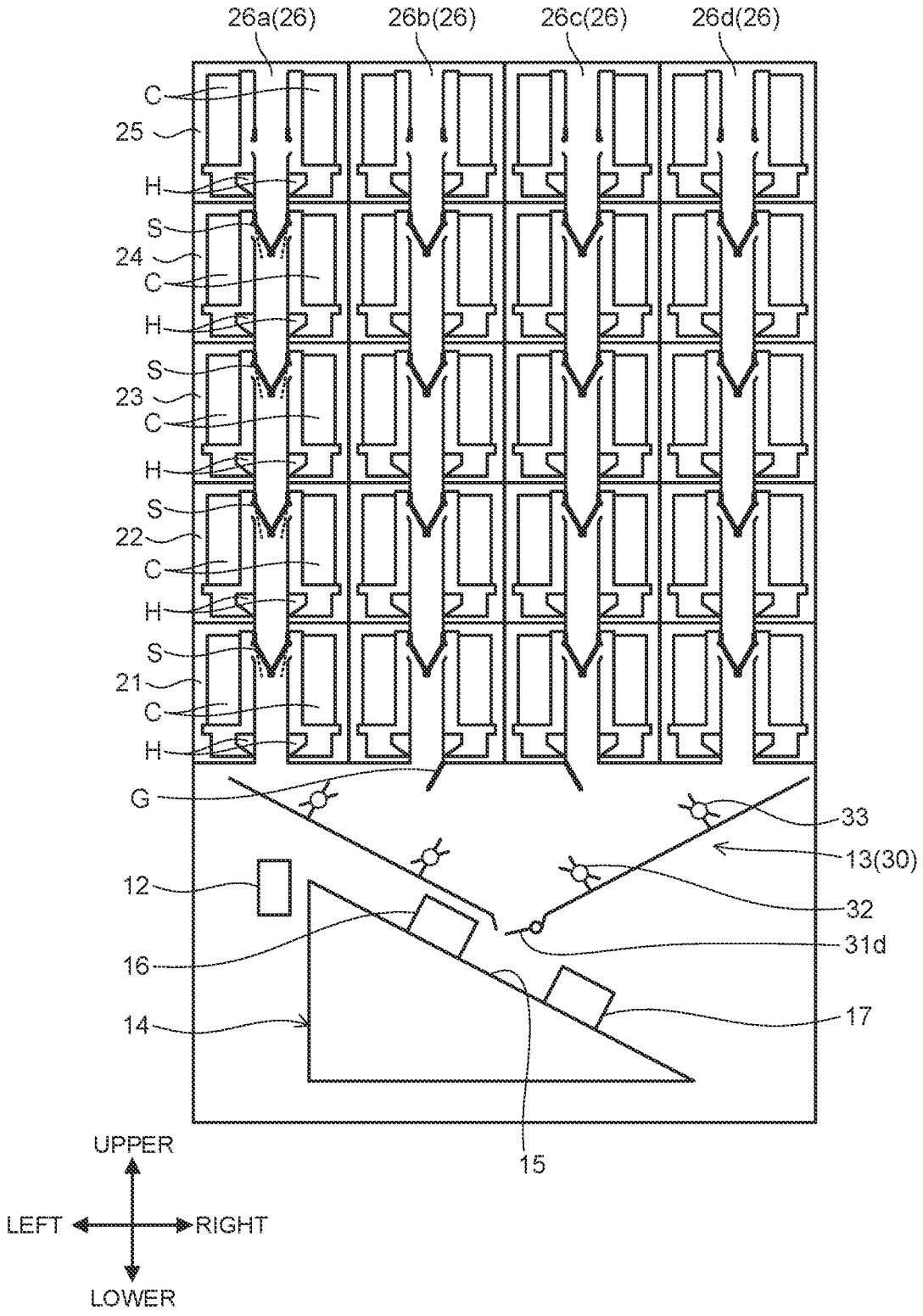
FIG. 2 is a longitudinal section view of the medicine dispensing apparatus illustrated in FIG. 1.

Hereinafter, Embodiment 1 for medicine dispensing apparatus 1 according to the present disclosure will be described in detail with reference to the accompanying drawings. Note that, in the following description, directions indicated by arrows in FIGS. 1 and 2 are referred to as upper, lower, left, and right, for convenience. In addition, the front side and back side of the paper are respectively referred to as the front side and back side of medicine dispensing apparatus 1.

FIG. 1 is a perspective view illustrating an example of medicine dispensing apparatus 1. Medicine dispensing apparatus 1 includes first level section 10 and second level section 20.

First level section 10 includes operation section 11 and outlet 12. First level section 10 also includes an input section (not illustrated), a controller (not illustrated), etc.

Operation section 11 is a device operated by an operator, and includes a display and operation keys, for example. When a user operates operation section 11, various information is inputted to medicine dispensing apparatus 1.

Medicine M packaged in medicine dispensing apparatus 1 is taken out from outlet 12. Outlet 12 includes an opening, and a user takes out medicine M from the opening.

The input section is an input apparatus to which various information is inputted from an external device. The input section is connected to, for example, a personal computer, and information of a prescription issued by a medical institution, for example, is inputted to the input section from the personal computer.

The controller is a control apparatus that controls each section of medicine dispensing apparatus 1. The controller controls operation section 11, for example. The controller also controls each section based on the information of the prescription inputted from the input section so that medicine M specified by the prescription is packaged in a packet and medicine M is transported to outlet 12.

Second level section 20 includes a plurality of drawers 21 to 25. Drawers 21 to 25 are stacked in this order from bottom to top. Each of drawers 21 to 25 includes a plurality of drawers arranged in the right-left direction. Note that the number of drawers included in second level section 20 is not limited to this, and second level section 20 may include more drawers or less drawers in the upper-lower direction and/or the right-left direction.

Next, the internal configurations of second level section 20 and first level section 10 will be described with reference to FIG. 2. FIG. 2 is a longitudinal section view of medicine dispensing apparatus 1.

Each of drawers 21 to 25 includes tablet case C that stores medicine M, and handling section H that lets out medicine M from tablet case C to passage 26 one by one. Medicine M let out by handling section H drops down passage 26 and is led out to first level section 10. Passage 26 passes through drawers 21 to 25 in the upper-lower direction. There are a plurality of passages provided corresponding to the number of drawers included in each of drawers 21 to 25 (four passages in the present embodiment: first passage 26*a* to fourth passage 26*d*). Passage 26 is provided with shutters S.

Shutters S are each configured to temporarily hold medicine M let out by handling section H. There are a plurality of shutters S provided for each of first passage 26*a* to fourth passage 26*d*. Shutters S are respectively provided at positions corresponding to handling sections H of drawers 22 to 25.

Shutters S are controlled by the controller so as to switch between open and closed states. In FIG. 2, the closed states of shutters S are indicated by solid lines, and the open states of shutters S are indicated by broken lines. The closed state is a state of holding medicine M. The open state is a state of dropping medicine M to passage 26.

Further, guide sections G are provided for some of passages 26, more specifically, inner passages 26 in the right-left direction. Guide sections G each set the dropping direction of medicine M led out from passage 26, and guide medicine M to the dropping position. Guide section G is formed in the shape of a plate, and placed so that medicine M drops through the plate surface. In Embodiment 1, guide sections G are provided at lower ends of second passage 26*b* and third passage 26*c*. Guide sections G guide medicines M to drop around holding section 32*b* of first rotation member 32, which will be described later. Note that the number or positions of guide sections G provided for passages 26 may be changed.

The operation of above-described second level section 20 will be described here. Medicine M is let out from upper handling section H, for example, according to information of a prescription described above, and held by shutter S corresponding to that handling section H. Then, that medicine M drops from that shutter S along passage 26, and is held by shutter S lower than that shutter S. At this time, another medicine M is let out from handling section H corresponding to the lower shutter S, and a plurality of medicines M are put together accordingly.

As described above, medicines M drop in order from shutter S to lower shutter S along passage 26, and a plurality of medicines M are put together in order according to the information of the prescription. Medicines M specified by the prescription are all put together and led out to first level section 10 from passage 26. In the following, medicines M put together are sometimes referred to as a medicine group.

Note that, during the operation of forming a single medicine group, a part or all of medicines M composing the next medicine group can be put together at shutter S located upper the single medicine group. Thus, providing a plurality of shutters S makes it possible to effectively form a plurality of medicine groups without mixing medicine M for one medicine group into another medicine group.

Next, first level section 10 will be described. First level section 10 includes hopper section 13 (30) and packaging unit 14. Hopper section 13 leads out medicines M (medicine group) to packaging unit 14. Hopper section 13 will be described later in detail.

Packaging unit 14 packages medicines M (medicine group) led out by hopper section 13. Packaging unit 14 includes transport section 15, printer 16, and sealing device 17.

Transport section 15 is a device that feeds out packaging paper from a roller (not illustrated) on which a double-folded strip of packaging paper is wound, for example, and transports the fed-out packaging paper to the sealing device 17 side. Medicines M led out by hopper section 13 are placed on the packaging paper and transported to sealing device 17 together with the packaging paper.

Printer 16 is a printing device that prints, on the front surface of the packaging paper fed out from the roller, the name of a patient, the name of medicine M to be supplied to the packaging paper, and the date and time of taking the medicine M, for example.

Sealing device 17 is a device that seals the packaging paper with medicine M packaged.

The packaging paper in which medicine M is sealed is cut at a predetermined timing, for example, and transported to outlet 12 by a certain device.

Figure 3:
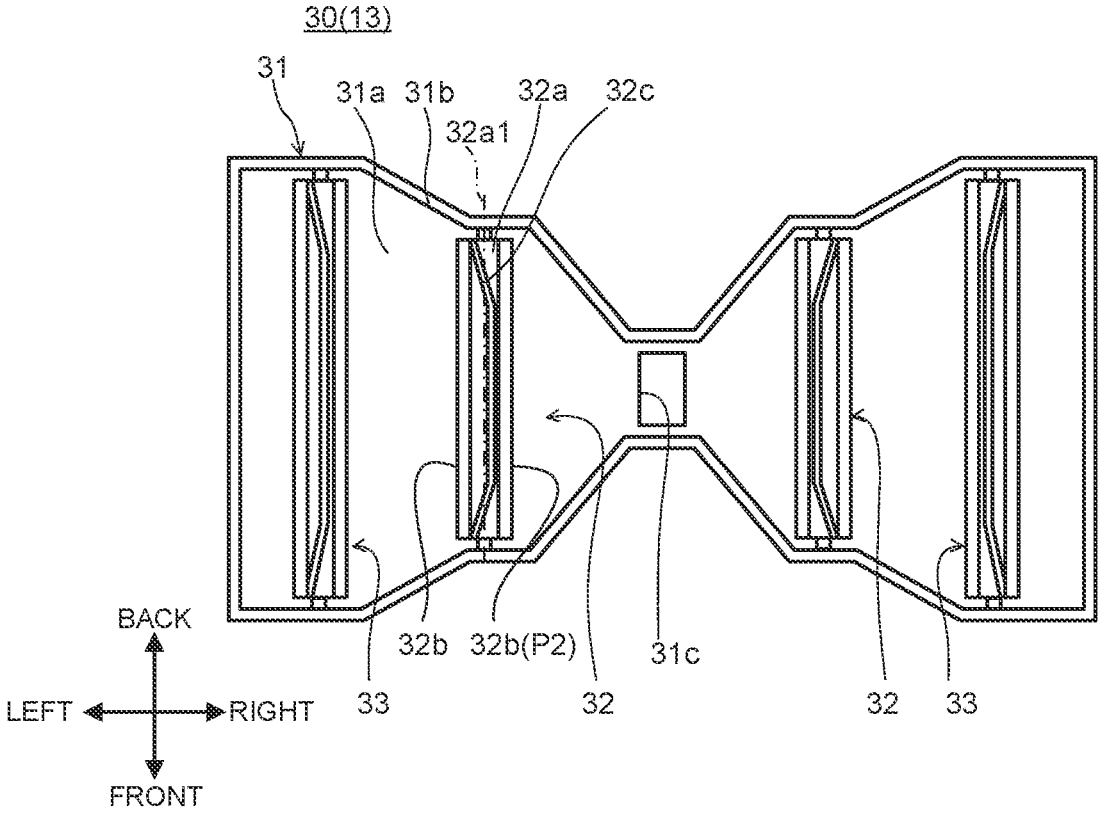
FIG. 3 is a top view of a hopper section illustrated in FIG. 2.
Figure 4:
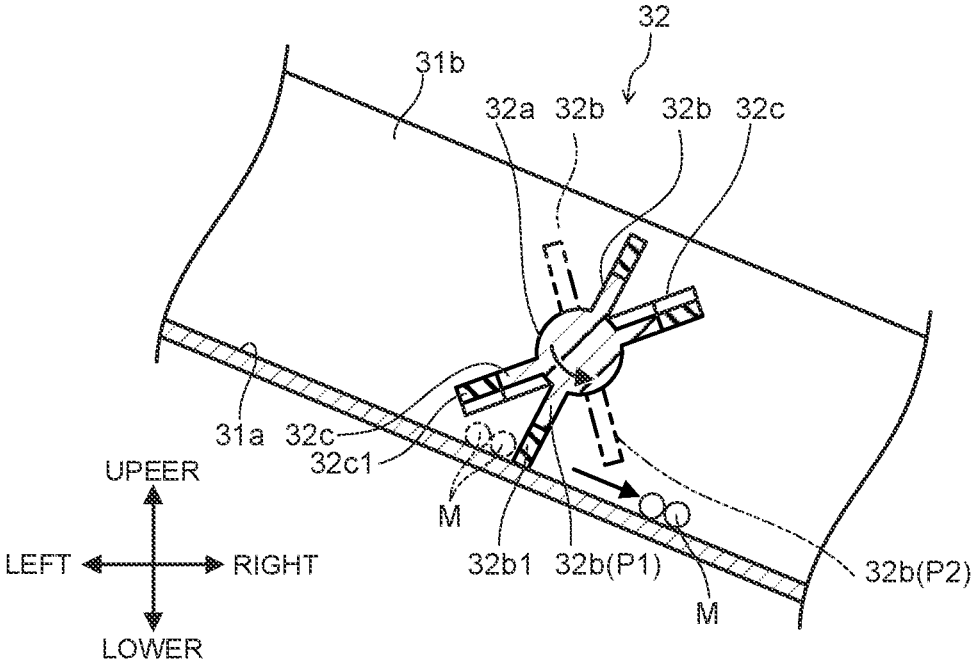
FIG. 4 is a side section view of a part of the hopper section illustrated in FIG. 3.

Next, hopper section 30 (13) will be described in detail with reference to FIGS. 3 and 4. FIG. 3 is a top view of hopper section 30 and illustrates holding section 32*b*, which will be described later, located in second position P2. FIG. 4 is a side section view of a part of hopper section 30 and illustrates holding section 32*b*, which will be described later, located in first position P1. Hopper section 30 includes hopper 31, first rotation member 32, and second rotation member 33.

Hopper 31 receives medicine M and causes medicine M to proceed to guiding port 31*c*. Hopper 31 includes base wall 31*a*, side wall 31*b*, guiding port 31*c*, and opening/closing member 31*d* (FIG. 2).

Base wall 31*a* is provided so that its wall surface faces passages 26 of second level section 20. Base wall 31*a* is formed so as to incline downward from the right and left ends to the center portion of hopper 31. In addition, base wall 31*a* is formed so that the length in the front-back direction is shorter from the right and left ends to the center portion of hopper 31. Medicine M let out from passage 26 is received on base wall 31*a* and proceeds to the center portion of hopper 31 along base wall 31*a*.

Guiding port 31*c* is formed at the center portion of base wall 31*a* and guides medicine M to the above-described packaging paper. Opening/closing member 31*d* switches its position between a closed position (FIG. 2) to close guiding port 31*c* and an open position to open guiding port 31*c*. When opening/closing member 31*d* is in the closed position, medicine M is held at the center portion of base wall 31*a*. When opening/closing member 31*d* is in the open position, medicine M is led out to the packaging paper. The position and operation timing of opening/closing member 31*d* is controlled by the controller.

Side wall 31*b* is formed all around the peripheral edge of base wall 31*a*. Side wall 31*b* prevents medicine M from dropping outside from hopper 31.

Hopper 31 is provided with two first rotation members 32 and two second rotation members 33 extending along the front-back direction. First rotation members 32 and second rotation members 33 are placed parallel to each other in the right-left direction so that first rotation members 32 are located on the side of the center portion of hopper 31. That is, first rotation members 32 are placed on the downstream side of the proceeding direction of medicine M with respect to second rotation members 33.

The only difference between first rotation member 32 and second rotation member 33 is the length in the front-back direction, and thus only first rotation member 32 will be described. Note that FIG. 4 illustrates first rotation member 32 located on the left side of hopper 31.

First rotation member 32 includes shaft member 32*a* formed in a cylindrical shape, holding section 32*b*, and delivering section 32*c*.

Shaft member 32*a* is placed along axis line 32*a*1 extending in the front-back direction on a horizontal surface, and supported by side wall 31*b* so as to be rotatable around axis line 32*a*1. Axis line 32*a*1 is the center axis of shaft member 32*a*. Shaft member 32*a* is rotated by a stepper motor (not illustrated) controlled by the controller.

Holding section 32*b* holds medicine M, and two holding sections 32*b* are formed. Holding sections 32*b* protrude from shaft member 32*a* in opposite directions toward each other in the centrifugal direction, and are formed in the shape of plates extending along the direction of axis line 32*a*1.

Holding section 32*b* switches its position between first position P1 to restrict the proceeding of medicine M and second position P2 to allow the proceeding of medicine M. Holding section 32*b* blocks medicine M with the plate surface when located in first position P1, and does not block medicine M when located in second position P2.

First position P1 is specifically a position where the end of one holding section 32*b* comes closest to base wall 31*a*. When one holding section 32*b* is in first position P1, the distance between one holding section 32*b* and base wall 31*a* is configured to be less than the size of medicine M. In the present embodiment, the end of one holding section 32*b* is configured to make contact with base wall 31*a*, so that the distance between one holding section 32*b* and base wall 31*a* is zero. That is, first position P1 is a position where the end of one holding section 32*b* makes contact with base wall 31*a*. When one holding section 32*b* is in first position P1, medicine M is blocked by making contact with the plate surface; accordingly, the proceeding of medicine M is blocked.

In addition, holding section 32*b* is provided with end section 32*b*1 made of an elastic material such as rubber. This causes end section 32*b*1 to elastically deform when the end of holding section 32*b* makes contact with base wall 31*a*, thereby not preventing the rotation of first rotation member 32. Further, even when medicine M is caught between end section 32*b*1 and base wall 31*a*, medicine M is not broken.

Second position P2 is specifically a position where one holding section 32*b* rotates around axis line 32*a*1 from first position P1 by counterclockwise rotation of shaft member 32*a* in FIG. 4, and configured to be a position on the guiding port 31*c* side of first position P1. In addition, second position P2 is configured so that the distance between the end of one holding section 32*b* and base wall 31*a* is larger than the size of medicine M. This causes no contact between medicine M and the plate surface of holding section 32*b*, thereby not blocking the proceeding of medicine M to guiding port 31*c*. Note that the other holding section 32*b* switches its position in the same manner as the one holding section 32*b* described above.

Note that, for first rotation member 32 located on the right side of hopper 31, shaft member 32*a* rotates clockwise in FIG. 2.

Delivering section 32*c* delivers medicine M held by holding section 32*b* to guiding port 31*c*, and two delivering sections 32*c* are formed. Delivering sections 32*c* protrude from shaft member 32*a* in opposite directions toward each other in the centrifugal direction, and are formed in the shape of plates extending along the direction of axis line 32*a*1. As described above, holding section 32*b* and delivering section 32*c* are integrally formed via shaft member 32*a*, and configured to rotate as a unit.

Upon rotation of first rotation member 32, the distance between delivering section 32*c* and base wall 31*a* is configured to be less than the size of medicine M when the end of delivering section 32*c* comes closest to base wall 31*a*. In the present embodiment, the end of delivering section 32*c* is configured to make contact with base wall 31*a*, so that the distance between delivering section 32*c* and base wall 31*a* is zero.

In addition, delivering section 32*c* is provided with end section 32*c*1 made of an elastic material such as rubber. This causes end section 32*c*1 to elastically deform when the end of delivering section 32*c* makes contact with base wall 31*a*, thereby not preventing the rotation of first rotation member 32. Further, even when medicine M is caught between end section 32*c*1 and base wall 31*a*, medicine M is not broken.

When one holding section 32*b* is in first position P1, one delivering section 32*c* is placed in a position on the side opposite to the guiding port 31*c* side of one holding section 32*b* and closer to one holding section 32*b* than the other holding section 32*b*. In this case, the distance between the end of one delivering section 32*c* and base wall 31*a* is configured to be larger than the size of medicine M. Note that the other delivering section 32*c* is provided in the same manner as the above-described one delivering section 32*c* so as to be in a position closer to the other holding section 32*b* than one holding section 32*b*.

Delivering section 32*c* is formed inclining against axis line 32*a*1 so that the front portion and back portion of the plate surface, which pushes medicine M, face guiding port 31*c* (FIG. 3).

Delivering section 32*c* delivers medicine M to guiding port 31*c* when holding section 32*b* is in second position P2. To be more specific, delivering section 32*c* rotates around axis line 32*a*1 to push or drive medicine M blocked by holding section 32*b* toward guiding port 31*c* with the plate surface.

In a case where medicine M is pushed or driven by delivering section 32*c* in such a manner, acceleration of medicine M is bigger than acceleration of medicine M in a case where the blockage by holding section 32*b* is just released and medicine M proceeds on hopper 31 without being pushed. Thus, delivering section 32*c* enables medicine M to proceed on hopper 31 in a short time.

Next, the operation of delivering medicine M (medicine group) by first rotation member 32 in hopper section 30 will be described. The description will start from a state where one holding section 32*b* is in first position P1 and opening/closing member 31*d* is in the closed state.

Medicine M led out from passage 26 is guided by guiding section G and drops on the upstream side of first rotation member 32 in the processing direction of medicine M. At this time, medicine M drops on a position relatively close to first rotation member 32. Medicine M dropped on base wall 31*a* proceeds to guiding port 31*c* along the inclination of hopper 31, and blocked with the plate surface of holding section 32*b* located in first position P1, as is the case with medicines M indicated by broken lines in FIG. 4.

Then, shaft member 32*a* rotates at a predetermined timing, and one holding section 32*b* changes its position from first position P1 to second position P2. The predetermined timing is when medicine M is blocked by one holding section 32*b*, e.g., when a first predetermined time (e.g., 1 second) has elapsed from the timing at which medicine M is led out from passage 26. The predetermined timing is configured by actual measurement through experiments, for example.

One delivering section 32*c* rotates around axis line 32*a*1 at the same time of one holding section 32*b* changing its position, and pushes medicine M toward guiding port 31*c* with the plate surface. Medicine M pushed by one delivering section 32*c* proceeds to guiding port 32*c*, as is the case with medicines M indicated by solid lines in FIG. 4. Note that force acting on medicine M from the plate surface and rotation speed of delivering section 32*c* are set so that medicine M proceeds on base wall 31*a* without stopping. First rotation member 32 further rotates and stops the rotation when the other holding section 32*b* comes to first position P1. Note that second rotation member 33 operates in the same manner as first rotation member 32.

Medicine M arrived at guiding port 31*c* is held by opening/closing member 31*d* in the closed state. Held medicine M (medicine group) is led out to packaging paper from guiding port 31*c* when opening/closing member 31*d* switches to the open state.

Medicine dispensing apparatus 1 according to the above described Embodiment 1 includes: hopper 31 that receives medicine M and causes medicine M to proceed to guiding port 31*c*; holding section 32*b* that is provided to hopper 31 and holds medicine M; and delivering section 32*c* that is provided to hopper 31 and delivers medicine M held by holding section 32*b* to guiding port 31*c*.

This configuration enables medicine M to smoothly proceed on hopper 31 in a short time. In addition, holding sections 32*b* are provided to a plurality of rotation members 32 and 33 arranged along the proceeding direction. This allows medicines M (medicine group) to proceed on hopper 31 without medicine M composing one medicine group mixed into another medicine group, even when a plurality of medicine groups drop on hopper 31.

Holding section 32*b* switches its position between first position P1 to restrict proceeding of medicine M and second position P2 to allow the proceeding of medicine M. Delivering section 32*c* delivers medicine M to guiding port 31*c* when holding section 32*b* is in second position P2.

This enables medicine M to reliably proceed on hopper 31 in a short time.

Holding section 32*b* is formed in the shape of a plate extending along the direction of axis line 32*a*1, blocks medicine M with the plate surface when located in first position P1, and does not block medicine M when located in second position P2.

This enables medicine M to more reliably proceed on hopper 31 in a short time.

Delivering section 32*c* is formed in the shape of a plate extending along the direction of axis line 32*a*1, and pushes medicine M to guiding port 31*c* with the plate surface by rotating around axis line 32*a*1.

This enables medicine M to further reliably proceed on hopper 31 in a short time.

Holding section 32*b* and delivering section 32*c* are configured to rotate as a unit.

This enables medicine M to reliably proceed on hopper 31 in a short time with a simple configuration.

Embodiment 2

Figure 5:
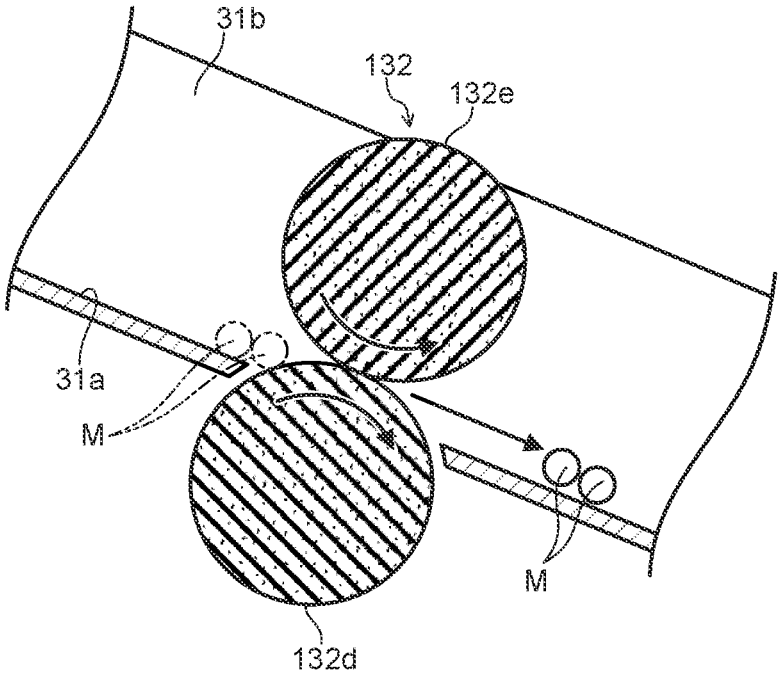
FIG. 5 is a side section view of a hopper section of a medicine dispensing apparatus according to Embodiment 2 of the present disclosure.

Next, Embodiment 2 of medicine dispensing apparatus 1 of the present disclosure will be described with reference to FIG. 5. The description is mainly for a part different from the above-described Embodiment 1. FIG. 5 is a side section view of hopper section 30 according to Embodiment 2. In Embodiment 2, first rotation member 132 and a second rotation member each include a first cylindrical member and a second cylindrical member, both formed in a cylindrical shape, instead of the configuration in Embodiment 1 described above. The only difference between first rotation member 132 and the second rotation member is the length in the front-back direction, and thus a description will be given of first cylindrical member 132*d* and second cylindrical member 132*e* of first rotation member 132.

First cylindrical member 132*d* and second cylindrical member 132*e* are placed so that the center axes are along the front-back direction, and formed so as to rotate around the center axes. Each of cylindrical members 132*d* and 132*e* is rotated by a motor (not illustrated) controlled by a controller.

Cylindrical members 132*d* and 132*e* are placed so that their circumferential side surfaces make contact with each other. In addition, cylindrical members 132*d* and 132*e* are vertically arranged so that the upper end portion of first cylindrical member 132*d* is located on the inner side of hopper 31. Cylindrical members 132*d* and 132*e* are made of an elastic material such as urethane foam.

Cylindrical members 132*d* and 132*e* block and hold medicine M with respective circumferential side surfaces when the rotation is stopped. To be more specific, medicine M is blocked, when proceeding to guiding port 31*c* on base wall 31*a*, by making contact with at least a circumferential side surface of first cylindrical member 132*d* among the respective circumferential side surfaces, as indicated by broken lines in FIG. 5. Medicine M is held while the rotation of cylindrical members 132*d* and 132*e* is stopped.

Then, cylindrical members 132*d* and 132*e* start rotating at a predetermined timing. During the rotation, cylindrical members 132*d* and 132*e* push medicine M toward guiding port 31*c*, as illustrated by solid lines in FIG. 5, by putting medicine M in between the respective circumferential side surfaces. To be more specific, the rotation of cylindrical members 132*d* and 132*e* causes held medicine M to be placed on the circumferential side surface of first cylindrical member 132*d* and transported in between the circumferential side surfaces of cylindrical members 132*d* and 132*e*. Medicine M is then put in between the circumferential side surfaces of cylindrical members 132*d* and 132*e*. At this time, cylindrical members 132*d* and 132*e* elastically deform toward the respective center axes so as to conform with the shape of medicine M.

Further, the rotation of cylindrical members 132*d* and 132*e* causes medicine M to be pushed toward guiding port 31*c*, as indicated by the solid lines. Note that force acting on medicine M from cylindrical members 132*d* and 132*e* and rotation speed of cylindrical members 132*d* and 132*e* are set so that medicine M proceeds on base wall 31*a* without stopping. The rotation of cylindrical members 132*d* and 132*e* is stopped at a timing when medicine M is pushed by cylindrical members 132*d* and 132*e*. The timing is, for example, when a second predetermined time (e.g., 1 second) has elapsed from the timing at which cylindrical members 132*d* and 132*e* start rotating. Cylindrical members 132*d* and 132*e* correspond to the "holding section" and "delivering section" since they hold and push medicine M as described above.

According to medicine dispensing apparatus 1 of Embodiment 2 described above, the holding section and delivering section are composed of first cylindrical member 132*d* and second cylindrical member 132*e* that are formed in a cylindrical shape so as to rotate around the center axes. First cylindrical member 132*d* and second cylindrical member 132*e* are placed so that their circumferential side surfaces make contact with each other. First cylindrical member 132*d* and second cylindrical member 132*e* block and hold medicine M with respective circumferential side surfaces when the rotation is stopped, and push medicine M toward guiding port 31*c* by putting medicine M in between the respective circumferential side surfaces when the rotation is performed.

This enables medicine M to reliably proceed on hopper 31 in a short time.

Embodiment 3

Figure 6:
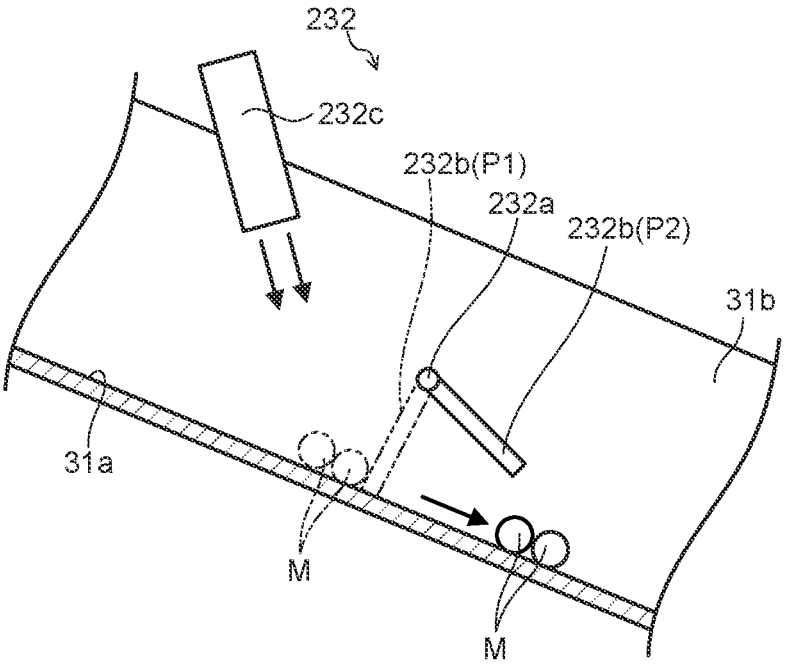
FIG. 6 is a side section view of a hopper section of a medicine dispensing apparatus according to Embodiment 3 of the present disclosure.

Next, Embodiment 3 of medicine dispensing apparatus 1 of the present disclosure will be described with reference to FIG. 6. The description is mainly for a part different from the above-described Embodiment 1. The above-described delivering section 32*c* of Embodiment 1 is provided integrally with holding section 32*b*. In contrast, delivering section 232*c* of Embodiment 3 is provided separately from holding section 232*b*.

Delivering section 232*c* of Embodiment 3 is an air blower that sends compressed air to medicine M held by holding section 232*b* to blow medicine M toward guiding port 31*c*. Delivering section 232*c* sends compressed air when holding section 232*b* is in second position P2. Delivering section 232*c* is controlled by a controller. Note that the velocity and flow rate per time unit of the compressed air sent by delivering section 232*c* are set so that medicine M proceeds on base wall 31*a* without stopping.

Variation

Medicine dispensing apparatus 1 according to one or a plurality of aspects has been described above based on the embodiments, but the present disclosure is not limited to such embodiments. Aspects in which variations conceived by those skilled in the art are applied to the present embodiments or aspects constructed by combining components in different embodiments may also be included within the scope of the one or a plurality of aspects without departing from the spirit or scope of the present disclosure.

In Embodiment 1 described above, holding section 32*b* and delivering section 32*c* are placed unevenly in the circumferential direction of shaft member 32*a*, but they may be placed evenly instead. In this case, holding section 32*b* may serve as delivering section 32*c*, or delivering section 32*c* may serve as holding section 32*b*.

In Embodiment 1 described above, end sections 32*b*1 and 32*c*1 of holding section 32*b* and delivering section 32*c* are formed of elastic materials to reduce the impact on medicine M, but they may be composed of brushes instead.

In Embodiment 1 described above, delivering section 32*c* is formed inclining against the direction of axis line 32*a*1 so that the front portion and back portion of the plate surface face guiding port 31*c*, but delivering section 32*c* may be formed so that entire delivering section 32*c* is along the direction of axis line 32*a*1.

In Embodiment 1 described above, holding section 32*b* and delivering section 32*c* are integrally formed via shaft member 32*a* so as to rotate as a unit, but instead of this, holding section 32*b* and delivering section 32*c* may be configured separately. In this case, delivering section 32*c* may push medicine M toward guiding port 31*c* with the plate surface not by rotating but by moving toward guiding port 31*c* on base wall 31*a*.

In Embodiment 2 described above, the holding section and delivering section are composed of two cylindrical members 132*d* and 132*e*, but only second cylindrical member 132*e* may be included instead. In this case, medicine M is pushed by being put in between the circumferential side surface of second cylindrical member 132*e* and base wall 31*a*.

The number of holding sections 32*b* and delivering sections 32*c* provided to shaft member 32*a* in Embodiment 1 may be varied. The number of rotation members provided to hopper 31 may also be varied in Embodiments 1 and 2. Further, the number of holding sections and delivering sections provided to hopper 31 may be varied in Embodiment 3.

The disclosure of Japanese Patent Application No. 2019-225239, filed on Dec. 13, 2019, including the specification, drawings and abstract, is incorporated herein by reference in its entirety.

INDUSTRIAL APPLICABILITY

The present disclosure is widely applicable to medicine dispensing apparatuses.

REFERENCE SIGNS LIST

1 Medicine dispensing apparatus
31 Hopper
31*c* Guiding port
32 First rotation member
32*a* Shaft member
32*a*1 Axis line
32*b* Holding section
32*c* Delivering section
33 Second rotation member
M Medicine
P1 First position
P2 Second position

The invention claimed is:

1. A medicine dispensing apparatus, comprising:

a hopper that receives a medicine on a base wall with inclination and causes the medicine to proceed to a guiding port along the base wall;

a holding section that blocks the medicine proceeding due to the inclination of the hopper; and a delivering section that delivers the medicine blocked by the holding section to the guiding port so that the medicine proceeds on the hopper, wherein:

the holding section switches its position between a first position to restrict proceeding of the medicine and a second position to allow the proceeding of the medicine, the delivering section delivers the medicine to the guiding port when the holding section is located in the second position, and the holding section is formed in a plate shape extending along a direction of an axis line, blocks the medicine with a plate surface when located in the first position, and does not block the medicine when located in the second position.

2. The medicine dispensing apparatus according to claim 1, wherein, the holding section and the delivering section are composed of a first cylindrical member and a second cylindrical member that are formed in a cylindrical shape and perform rotation around respective center axes, and the first cylindrical member and the second cylindrical member:

are placed so that respective circumferential side surfaces make contact with each other; and block and hold the medicine with the respective circumferential side surfaces when the rotation is stopped, and push the medicine toward the guiding port by putting the medicine in between the respective circumferential side surfaces when the rotation is performed.

3. The medicine dispensing apparatus according to claim 1, wherein the delivering section is formed in a plate shape extending along a direction of an axis line, and pushes, with a plate surface, the medicine toward the guiding port by rotating around the axis line.

4. The medicine dispensing apparatus according to claim 3, wherein the delivering section includes a portion inclining against the axis line so that the plate surface faces the guiding port.

5. The medicine dispensing apparatus according to claim 3, wherein the holding section and the delivering section are configured to rotate as a unit.

* * * * *